US008028381B2

(12) United States Patent
Murray

(10) Patent No.: US 8,028,381 B2
(45) Date of Patent: Oct. 4, 2011

(54) LOAD BEARING TEXTILE CLAMP

(76) Inventor: Michael Edward Murray, Jupiter, FL (US)

( * ) Notice: Subject to any disclaimer, the term of this patent is extended or adjusted under 35 U.S.C. 154(b) by 391 days.

(21) Appl. No.: 12/386,859

(22) Filed: Apr. 24, 2009

(65) Prior Publication Data

US 2009/0205166 A1 Aug. 20, 2009

Related U.S. Application Data

(63) Continuation-in-part of application No. 11/818,044, filed on Jun. 13, 2007, now abandoned.

(51) Int. Cl.
*A44B 99/00* (2010.01)
*A47H 13/00* (2006.01)

(52) U.S. Cl. ..... 24/460; 24/487; 24/461; 24/462; 160/395; 160/399; 160/402; 160/403

(58) Field of Classification Search ..... 24/487, 24/459, 460, 461, 462; 160/380, 378, 395, 160/399, 402, 403, 273.1, 290.1, 270, 267.1; 38/102.91

See application file for complete search history.

(56) References Cited

U.S. PATENT DOCUMENTS

| | | | | | |
|---|---|---|---|---|---|
| 1,055,489 | A * | 3/1913 | Pendery | 160/395 |
| 1,738,273 | A * | 12/1929 | Anderson | 40/209 |
| 1,766,730 | A * | 6/1930 | Traut | 160/267.1 |
| 1,909,109 | A * | 5/1933 | Kopfstein | 160/384 |
| 2,266,466 | A * | 12/1941 | Linder | 160/378 |
| 4,356,647 | A * | 11/1982 | Farris | 40/759 |
| 4,903,629 | A * | 2/1990 | Maudlin et al. | 24/462 |
| 2009/0205166 | A1 * | 8/2009 | Murray | 24/460 |

* cited by examiner

*Primary Examiner* — Robert Sandy

(57) ABSTRACT

A removable load bearing textile clamp including a locking clamp portion configured to accept an internally positioned rod such that a textile sheet can be led around the rod and positioned inside the clamp and secured by closing the clamp and engaging the locking mechanism.

9 Claims, 4 Drawing Sheets

LOAD BEARING TEXTILE CLAMP

CROSS REFERENCE TO RELATED APPLICATION

This application is a Continuation-in-Part of patent application Ser. No. 11/818,044, filed on Jun. 13, 2007, now abandoned.

FEDERALLY SPONSORED RESEARCH

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

FIELD OF THE INVENTION

This invention relates to methods of reinforcing and attaching the edges of a textile panel such that they are able to convey loads into a secondary structure such that the load is resisted, energy is transferred, and the panel does work. Primarily, load bearing articles made of textiles are designed to work in tension, where the strength and orientation of fibers are a determining factor in how the article is used, and the method to transition loads into a secondary structure is a determining factor in the load bearing capacity of the article. Articles such as lifting devices, tension structures and protective barriers such as blast screens and hurricane shutters are examples of products where the tensile strength and lightweight properties of modern textiles have been used to create new products.

BACKGROUND OF THE INVENTION

For millennia, man has used woven textile goods for a variety of domestic and industrial applications. To enable woven materials to be put to use, techniques were developed to reinforce the edges such that the textile could be attached to a secondary structure to do work. As an example, seafarers from antiquity developed the durable techniques of sewing attachment straps and using grommets on those reinforced edges that allowed cloth panels to be affixed to a secondary structure such as a mast and connected to a pole or control rope to drive a vessel through the water by the force of wind. Two principle factors limited the ability of a sail to transfer the potential wind energy into a force to drive a vessel: the first being the strength of the cloth; the second being the method used to reinforce the edge and affix the sailcloth to the support structure. While today these traditional techniques are widespread, it was over much of the course of known history that these methods were developed.

The range of applications for industrial textiles prior to the development of modern synthetic materials was self limiting. Natural fibers could be made no stronger than their natural state. The techniques based on principles of sewing hems to reinforce the edge and attaching grommets or straps to fasten the textiles made from these fibers were largely sufficient, as the strength of these methods of reinforcement and attachment often exceeded the strength of the fibers in the textile itself. The only way to make a stronger textile panel was to increase the quantity of fibers in the textile. Textiles of natural fibers quickly became impractical for many high load applications which naturally limited the development of additional uses and methods of attachment. The rise of modern synthetic fibers yielded textiles that are far stronger than textiles of natural fibers and have resulted in a vast number of new and innovative products.

Current art describes a range of textile devices intended for load applications which use some form of the traditional methods to reinforce and attach the edges. U.S. Pat. No. 6,176,050 issued to Gower and U.S. Pat. No. 6,959,748 issued to Hudoba show examples of textiles used as a hurricane barriers. Gower uses straps sewn onto a hemmed and stitched edge, while Hudoba uses grommets on an edge reinforced by welding a second strip of material. Similar to Gower, U.S. Pat. No. 4,781,473 issued to LaFleur shows straps for lifting sewn onto a large flexible material bulk container whose edges have been reinforced with layered and stitched hems. Similar to Hudoba, U.S. Pat. No. 5,529,321 issued to Thompson shows a hauling harness for a load carrying tarp which has double layer reinforced edges with grommets. U.S. Pat. No. 7,216,908 issued to Daigle, shows a textile lift bag used to load and unload bulk materials more easily; its edges are hemmed and reinforced with sewn on webbing to which lift straps are sewn. U.S. Pat. No. 4,290,243 issued to Mellin discloses a method of attaching a fabric used in tension structures; this system reinforces the edge of the textile with a hemmed in cable, which is then used as an attachment point for the secondary structure.

The applications listed above demonstrate uses for textiles using traditional methods to secure the reinforced the edge of the textile and attach it to a secondary structure. While these current methods of sewn or welded hems to reinforce edges using straps or grommets to transfer loads are generally successful in moderate load applications, they do not perform as well as possible. Point loading tends focus the load to a limited number of fibers within the panel around the points of attachment such as grommets or straps. This places a greater strain on the fibers directly in line with the grommet or strap making these fibers vulnerable to failure. Additionally, distortion occurs along the border edges as the few fibers aligned with the anchor points bear the greatest percentage of the load. Compounding failures occur across the reinforced edge as the highly tensioned fibers break, causing shock loads to the remaining fibers which cause them to break as well.

Another family of current art uses better load distribution along the edge of the load bearing textile. U.S. Pat. No. 5,915,449 issued to Schwartz describes a textile blast screen which uses a hemmed in rod to reinforce the top and a hemmed in lead weight to reinforce the bottom; these also serve as attachment points. U.S. Pat. No. 5,746,343 issued to Waltke et al shows a textile bag for liquids supported by having its edges sewn onto a frame. Similarly, U.S. Pat. No. 5,329,719 issued to Holyoak shows a textile containment method for raising and harvesting fish in a body of water having edges that are also sewn onto a frame. While these products have less likelihood of failure at the attachment point and less likelihood of distortion because the loads are better distributed across the panel, the sewn hem is still a potential point of failure. When structural elements are comprised of stitched materials, the panel is subject to stress failure due to shear loading of the stitch. Further still, the process of stitching fabric inherently weakens the textile. Damage to the thread itself, whether by abrasive action or ultraviolet degradation is a concern to manufacturers and consumers of load bearing textile devices. The difficulty is in identifying the progressive degradation and establishing a time period and protocol by which the effective service life of the device can be determined. Additionally, current art disclosures that rely on traditional methods of manufacture are not able to take advantage of labor saving manufactured components and are therefore required to have skilled labor, large facilities and complex machinery to produce a reliable and consistent product. Ultimately these disadvantages increase consumer costs and make the products less desirable. Additionally still, no part of a sewn seam or grommet assembly can be reused nor is it easily repaired in the field.

Current art shows that industry has recognized these problems and has set forth a range of textile clamps and attachment methods which attempt to address the issues above. U.S. Pat. No. 4,686,748 issued to Kaivanto, U.S. Pat. No. 5,692,272 issued to Woods, and U.S. Pat. No. 5,168,605 issued to Bartlett each show a clip for holding fabric. While these clips are all improvements over sewn methods, they still describe single points of attachment that are subject to the same point loading concerns previously noted. In order to distribute loads evenly across the terminating edge, an excess of these textile clamps would be required. U.S. Pat. No. 2,266,466 issued to Linder sought to remedy the issue of point loading and the requirement for skilled labor to assemble chair seats. Linder describes a continuous strip of material worked in such a way to form a clamping jaw, where the jaw interacts with a rod and fabric to form a textile clamp. In use the clamping jaw is first held closed by a series of rivets then the clamp is secured to a chair frame with a fastener. One drawback of Linder is the requirement of punching multiple holes to secure the strip to the textile making it a labor intensive operation requiring specialized tools and not practical for use in the field. Another drawback is the inability to mass manufacture a functional item in a single piece.

Limited to methods described in prior art for securing a textile panel to a secondary structure, industry is not able to take full advantage of the strength of modern fibers in high load applications. What is needed is a method to further increase the load carrying capacity of an article made of high strength synthetic fibers which may be applied/affixed/deployed without the need for specialized skill, facilities or tools.

BRIEF SUMMARY OF THE INVENTION

The invention describes a load bearing textile clamp that, in conjunction with a textile sheet, forms a load bearing textile panel. It is removably attached and can be configured and reconfigured to a number of applications having the qualities of lightness, strength, flexibility and durability.

Several objects and advantages of the present invention are:

(1) To provide a device that maximizes the use of the fiber strength in textiles, particularly those made from modern synthetic fibers.

(2) To provide a device that serves as an intermediary between a textile sheet and a secondary structure which is incorporated into the edge of the textile sheet forming a textile panel that accumulates loads which can then be transferred to a secondary structure.

(3) To provide a device that can be attached to textile sheets quickly without tools or fasteners minimizing time and cost of assembly.

(4) To provide a simple device that can be used by non skilled individuals.

(5) To provide a device that is durable and weather resistant.

(6) To provide a device that is reusable.

(7) To provide a device that enables textiles to be used in new and innovative ways.

(8) To provide a device that is inexpensive to manufacture.

(9) To provide a device that is modular, and can be used in part, as a whole, or in combination with other devices.

(10) To provide a device that is lightweight, compact, and easy to store when not in use.

(11) To provide a device that does not require specialized equipment, fabrication facilities, or methods of assembly such as sewing machines, welding, adhesives, or other means to secure it to the textile.

(12) To provide a device that is capable of being used with a wide range of textiles.

(13) To provide a device used in high load applications such as large tents, trucking tarps, heavy lift tarpaulins, etc. For example, this invention may be used in the hurricane protection industry where high strength textiles are used as hurricane shutters and storm panels in any manner of situations where they serve to cover windows, doors, open areas and even roofs to block wind, debris impacts or serve as mechanical resistors to uplift forces or direct wind pressures.

Further objects and advantages will become apparent from a consideration of the ensuing description and drawings.

BRIEF DESCRIPTION OF THE SEVERAL VIEWS OF THE DRAWING

In the drawings, repeat figures have the same number.

DRAWINGS

Reference Numerals

Figure 1:
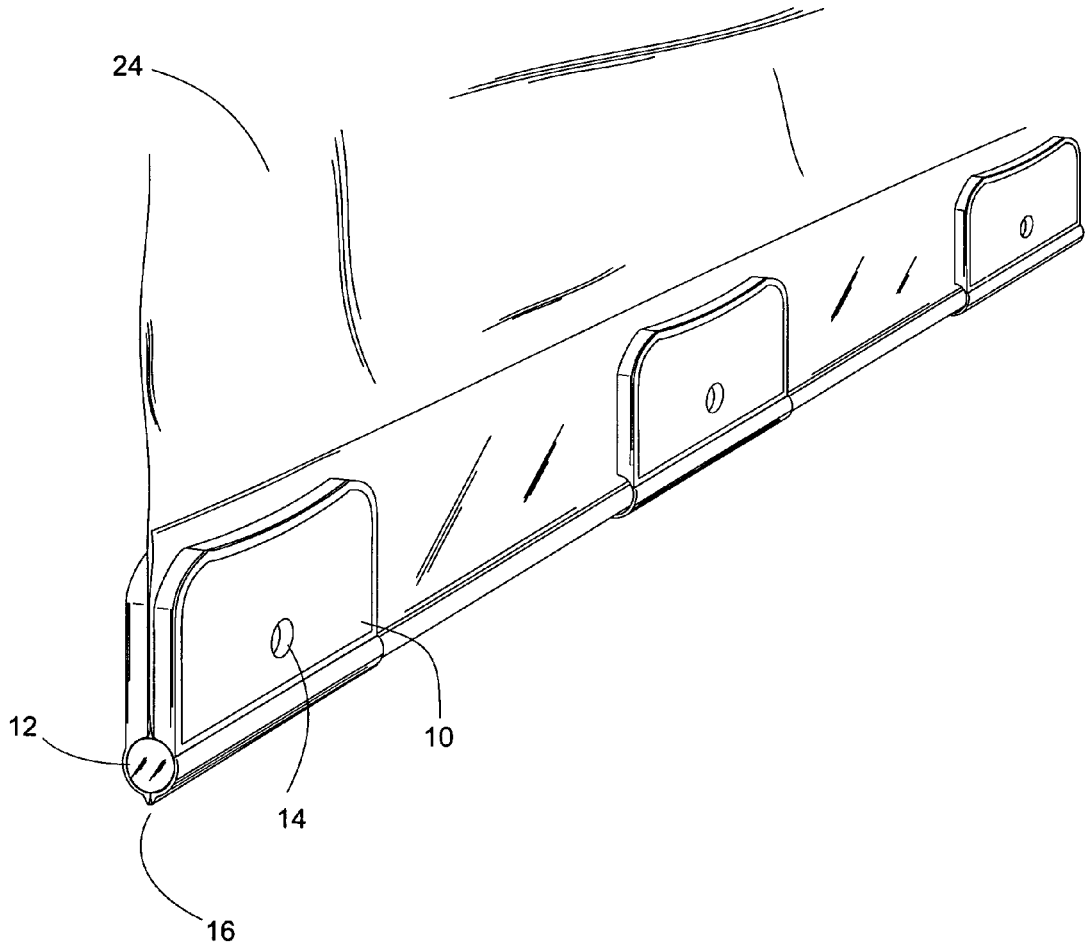
FIG. 1 shows a perspective view of a series of clamps attached to a textile sheet forming a textile panel.
Figure 2:
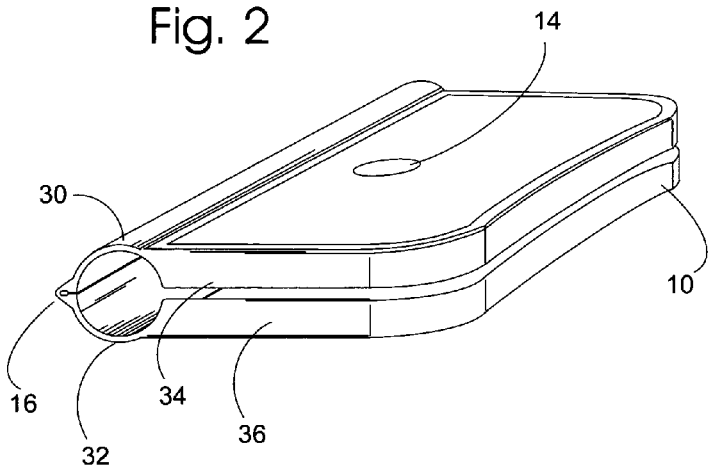
FIG. 2 shows a close-up view of a clamp without the rod.
Figure 3:
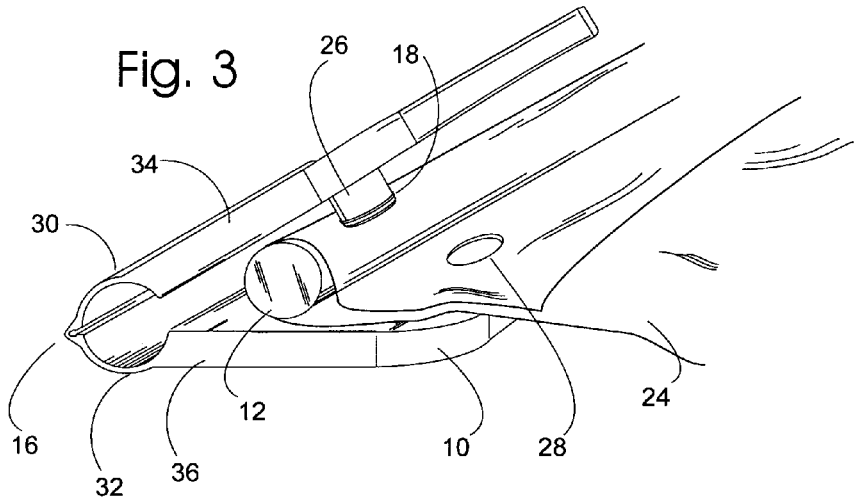
FIG. 3 shows a close-up view of a clamp showing how the textile sheet and rod are inserted and part of the locking mechanism.
Figure 4:
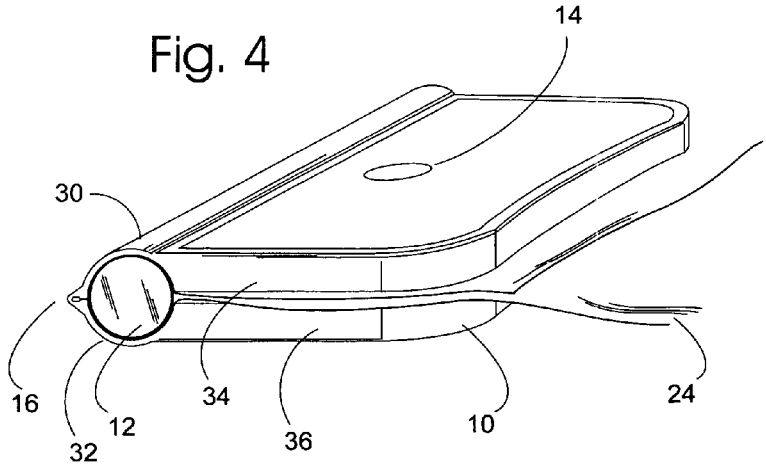
FIG. 4 shows a close-up view of a clamp, textile sheet, and rod locked together.
Figure 5:
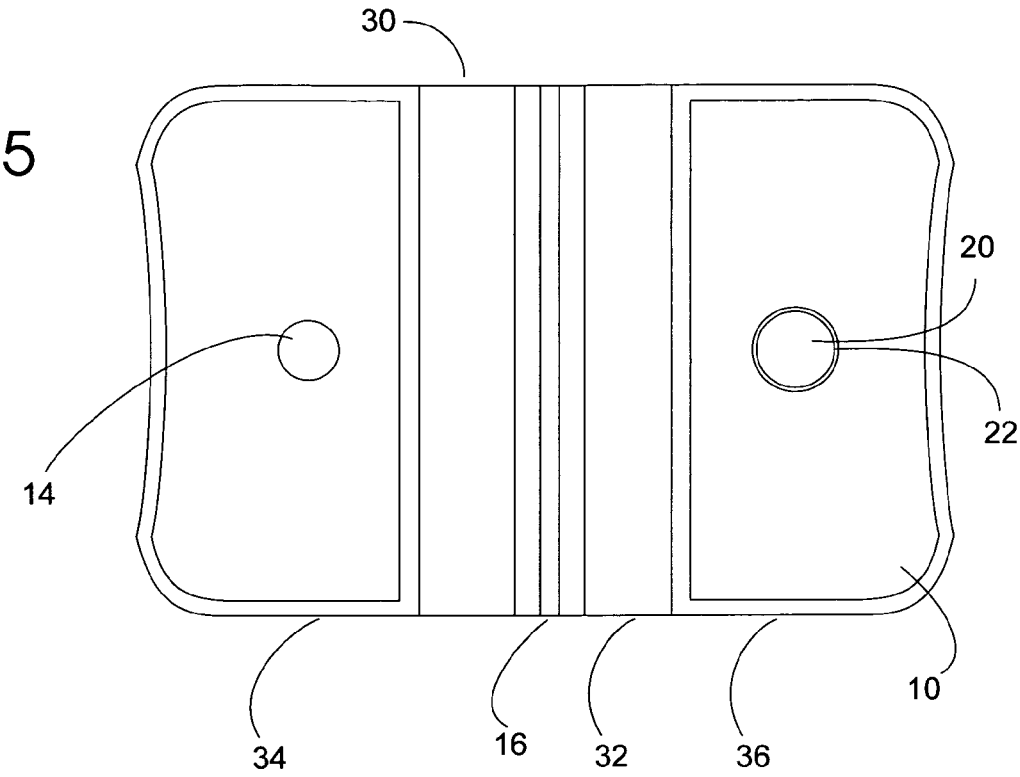
FIG. 5 shows a top view of the unfolded clamp.
Figure 6:
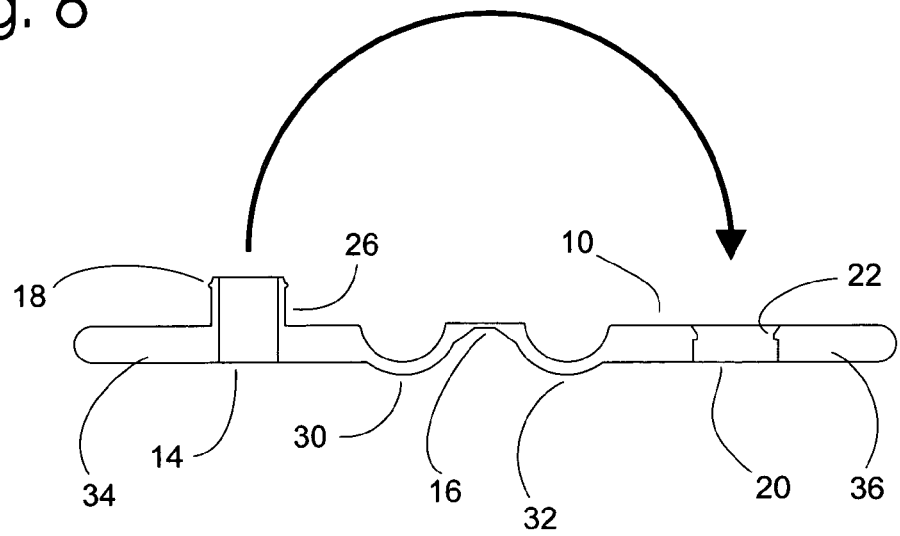
FIG. 6 shows a side view of the unfolded clamp with details of the locking mechanism, the arrow indicates how the clamp is closed.
Figure 7:
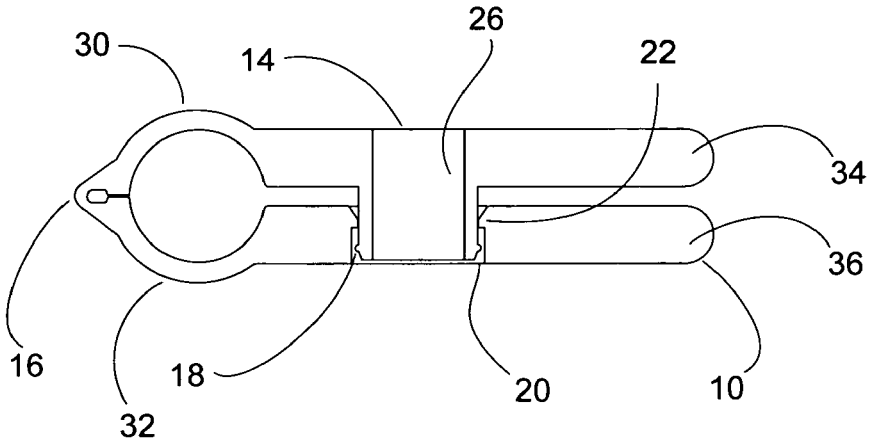
FIG. 7 shows a cross section of a closed clamp with locking mechanism engaged.
Figure 8:
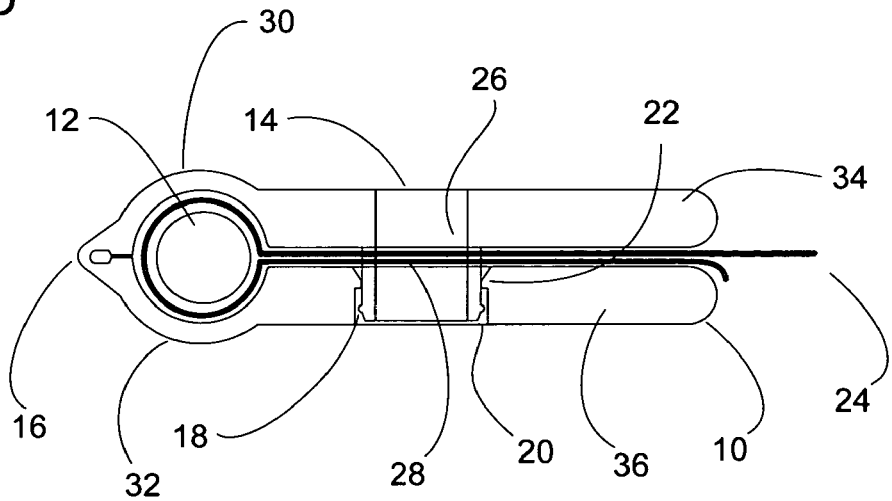
FIG. 8 shows a cross section of a closed clamp showing the textile sheet and rod are held within the clamp.

| | |
|---|---|
| 12 | Rod |
| 14 | First Hole |
| 16 | Living Hinge |
| 18 | Lip |
| 20 | Second Hole |
| 22 | Catch |
| 24 | Textile Sheet |
| 26 | Neck |
| 28 | Textile Sheet Hole |
| 30 | First Curved Section |
| 32 | Second Curved Section |
| 34 | First Flat Side |
| 36 | Second Flat Side |

DETAILED DESCRIPTION OF THE INVENTION

This invention describes an intermediary device between a textile sheet and a secondary structure which allows a textile sheet to perform as a load bearing panel. The invention replaces the typical and laborious task of gluing and/or sewing reinforcements and/or affixing grommets and/or riveted plates into textile sheets to create a load bearing edge.

These goals are achieved by the invention by wrapping the edge of a textile sheet around a rod and securing the rod and textile within a locking clamp. The clamp is comprised of a thin rectangular component with a living hinge in the center and with complementary flat sides and curved sections to hold a rod, and complementary surfaces integrated into a hole in the clamp to create a locking mechanism. The first hole in the clamp is elongated on one side forming a neck with a lip; the second hole is enlarged to receive the neck and has a catch for the lip. When folded on itself, the rectangle forms a U-shaped sleeve that becomes a compressive clamp around the rod and textile once the locking mechanism is engaged. To apply the clamp to a textile sheet, the edge of the textile is folded around the rod with sufficient overlap, a hole is made in the textile where the fastener will be and then the rod and textile are inserted into the curved sections of the U-shaped sleeve. As the two flat sides of the U-shaped sleeve are pressed together, curved sections hold the rod, and the locking mechanism is engaged through the hole in the textile and the clamp is secured to the textile sheet forming the load bearing edge of a panel. The elongated neck of the first hole of the clamp conceals the hole cut in the textile for a professional finish. The first and second holes also form an opening where an anchoring fastener can be inserted to secure the panel to a substrate. In use a series of clamps are placed along the edge of textile sheet and rod, the number and spacing of the clamps in relation to the size of the panel determines the load capacity of the panel.

The textile clamp is of such size as to be easily managed. However, the invention could be made larger or smaller, longer or shorter, and multiple assemblies can be placed end-to-end as required by the application.

In manufacturing, it is preferred that the clamp is manufactured as a single unit by injection molding utilizing a durable thermoplastic with high resiliency. It is preferred to use materials resistant to UV and other forms of degradation. Further, it is preferred that the rod is comprised of a material with high resiliency and resistant to compression. While these materials and methods are preferred embodiments of the invention, other materials and methods maybe used to more efficiently produce the parts and the future may yield new materials that may enhance performance. Any of these improved items may be incorporated into the invention without altering the spirit of the invention.

While the invention offers a solution primarily for use in the construction of high load bearing textile panels such as textile-based hurricane panels to protect windows and other openings, the clamp has many other uses in many fields of endeavor where industrial textiles are currently used; such as commercial fishing, fish farming, tent and tarpaulin manufacturing and repair, riparian management, land stabilization, commercial awnings, billboards, signage, sail making, oil and agriculture industry, ocean engineering, and others. Nothing should be construed from this description to limit the scope of this invention.

I claim:

1. A load bearing textile clamp comprising:

a) a locking clamp having a substantially flat cross section comprised of a first flat side with a first curved section and a second flat side with a second curved section, each of said curved sections being joined to each other by a living hinge, where said hinge allows said locking clamp to be closed forming a U-shaped sleeve;

b) a rod of variable length;

c) said rod being entrapped within a space formed by said curved sections of said locking clamp;

d) said curved sections of said locking clamp being shaped complementary to said rod;

e) said rod and said locking clamp in conjunction with a textile sheet forming a clamp assembly;

g) said first flat side having a first hole with an elongated neck and a lip;

f) said second flat side having a second hole complementary to said first flat side hole with a catch; and h) said clamp assembly being secured by a locking mechanism incorporated into said first hole and second hole of said locking clamp.

2. A load bearing textile clamp of claim 1 such that said textile sheet is positioned around said rod and back on itself then inserted into a space formed by said curved sections of said locking clamp.

3. A load bearing textile clamp of claim 1 such that said clamp assembly is secured by a locking mechanism incorporated into the body of said locking clamp, such that upon closing said locking clamp said locking mechanism is engaged through a hole cut in said textile sheet.

4. A load bearing textile clamp of claim 1 where said first hole elongated neck conceals edges of a hole in said textile sheet.

5. A load bearing textile of claim 1 where said first hole elongated neck and said second hole form an opening for a fastener.

6. A load bearing textile clamp of claim 1 where said rod is of a durable material resistant to compression and degradation.

7. A load bearing textile clamp of claim 1 where said locking clamp is of a durable material resistant to degradation.

8. A load bearing textile clamp of claim 1 where said locking clamp is formed in a single piece by injection molding.

9. A load bearing textile clamp of claim 1 where a series of locking clamps placed along the edge of a textile sheet forms a load bearing textile panel where the number and spacing of said locking clamps determines the load capacity of said panel.

* * * * *